United States Patent [19]

Borden

[11] 4,083,479

[45] Apr. 11, 1978

[54] SEWING AID FOR HANDICAPPED PERSONS

[76] Inventor: Marceia L. Borden, 7533 Hanover, Detroit, Mich. 48206

[21] Appl. No.: 759,647

[22] Filed: Jan. 17, 1977

[51] Int. Cl.[2] ..... A41H 31/00

[52] U.S. Cl. ..... 223/100; 248/176

[58] Field of Search ..... 223/106, 107, 108, 109, 223/100, 120; 248/176

[56] References Cited

U.S. PATENT DOCUMENTS

| | | | |
|---|---|---|---|
| 872,296 | 11/1907 | Hoskins | 223/106 |
| 877,522 | 1/1908 | Schroeder | 223/106 X |
| 1,297,016 | 3/1919 | Schoenl | 223/DIG. 2 |
| 2,746,702 | 5/1956 | Gourley et al. | 248/176 X |
| 2,994,488 | 8/1961 | Waddell | 248/176 X |
| 3,503,581 | 3/1970 | Rouleau | 248/176 |
| 3,738,405 | 6/1973 | Ericson | 248/176 X |
| 3,955,722 | 5/1976 | Bard | 223/106 |

FOREIGN PATENT DOCUMENTS

| | | | |
|---|---|---|---|
| 275,210 | 8/1913 | Germany | 223/109 R |

*Primary Examiner*—George H. Krizmanich
*Attorney, Agent, or Firm*—Barnes, Kisselle, Raisch & Choate

[57] ABSTRACT

A sewing aid for handicapped persons which includes a mounting base for a support surface, an arm upright on said base flexible to move to various positions and a high friction relatively light cylinder on said arm to hold fabrics and garments in a stabilized position so that sewing can be done with one hand. Various shapes can be utilized for sewing operations and a retainer on the support arm is used for sewing accessories.

4 Claims, 6 Drawing Figures

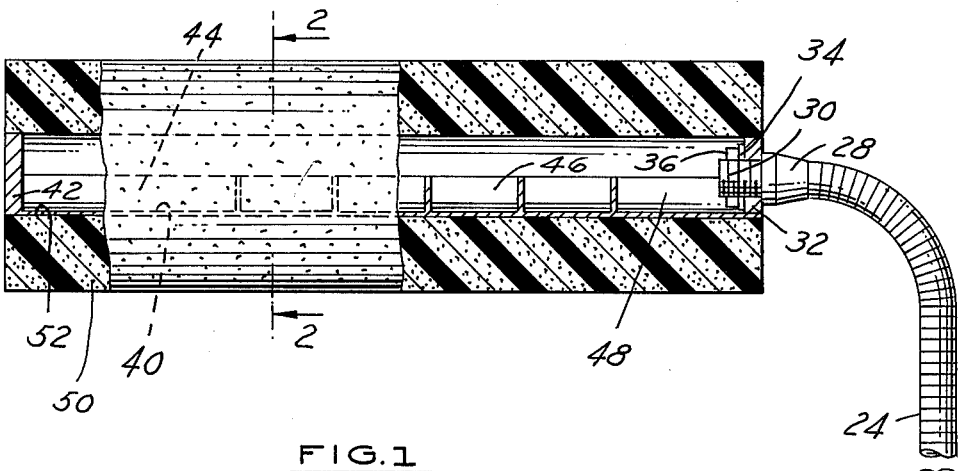
FIG. 1
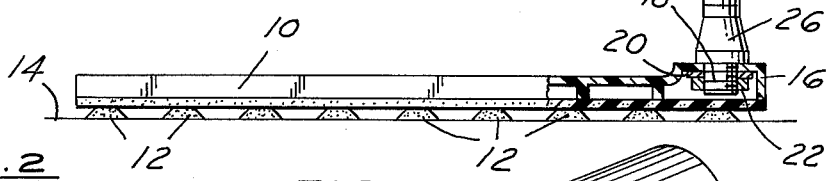
FIG. 2
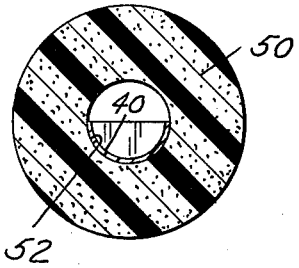
FIG. 3
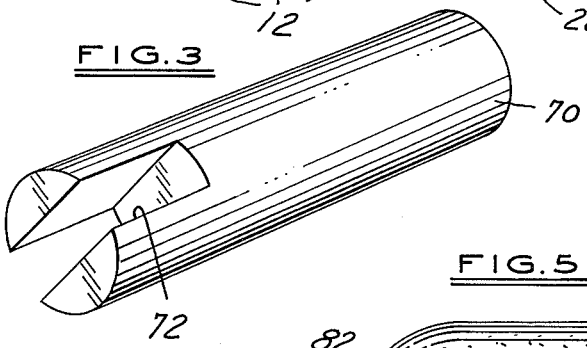
FIG. 5
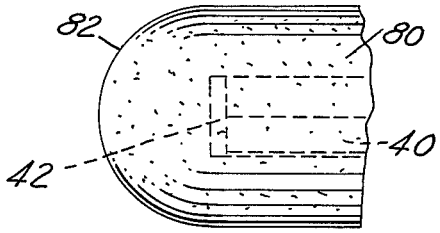
FIG. 4
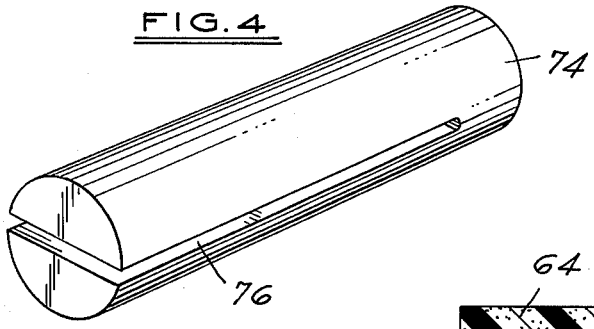
FIG. 6
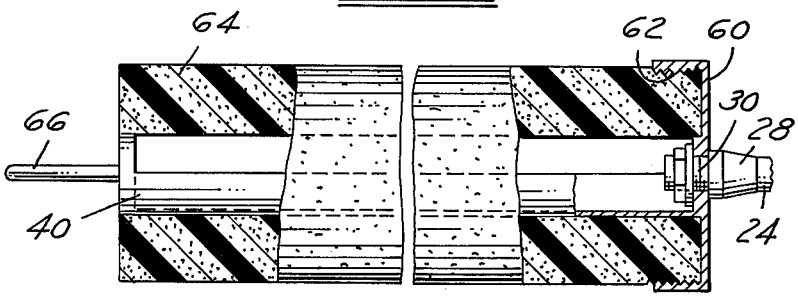

SEWING AID FOR HANDICAPPED PERSONS

This invention relates to a Sewing Aid for Handicapped Persons.

Many persons who are handicapped by the loss of a hand or fingers or by crippling arthritis have difficulty sewing garments and cloth material because of the problems in holding the material and stabilizing it while the hand holding the needle can perform the sewing operations.

It is, therefore, an object of the present invention to provide an apparatus for stabilizing garments and yard goods so that it may be conveniently sewed with one hand.

A further object is the provision of a sewing aid which can be readily fastened to a surface or which can be located near the person who is in a sitting position so that the device will be handily positioned for its function.

Another object is the provision of a sewing aid which can retain the necessary sewing equipment such as thread, needles and so on in a manner which makes them readily available for the handicapped person.

Other objects and features of the invention relating to the details of construction will be apparent in the following description and claims in which the principles of the invention is set forth, together with details which would enable a person skilled in the manufacturing arts to construct the device, all in connection with the best mode presently contemplated for the practice of the invention.

Drawings accompany the disclosure, and the various views thereof may be briefly described as:

FIG. 1, a side elevation of the device, partially in section.

FIG. 2, a sectional view on line 2—2 of FIG. 1.

FIG. 3, a view of a modified element for a special sewing function.

FIG. 4, a second modified cylinder for specialized use.

FIG. 5, a modified end construction for a holding element.

FIG. 6, a modified end construction for special applications, showing also a modified mounting.

REFERRING TO THE DRAWINGS

The structure to serve as the sewing aid for the handicapped comprises, first, a base which can preferably be a rectangular plate 10 of light material having a dimension approximately 6 inches wide and 10 inches long having fastened on the bottom thereof a plurality of suction cups 12. These suction cups enable the base plate 10 to be fastened to a smooth surface 14 in a secure manner although this permits the plate to be moved from time to time from one position to another.

At one end of the plate 10 a raised portion 16 has an opening to receive a threaded projection 18 held in place by a washer 20 and a nut 22. The plate is preferably formed of two pieces secured together so that the washer and nut could be welded or otherwise secured in place prior to the assembly of the plate. A gooseneck flexible arm 24 has a base fixture 26 secured to the threaded projection 18 and this extends upwardly and can be curved in a number of different directions. A free end 28 has a threaded extension 30 which mounts a disc 32 carrying also a washer 34 and a nut 36. On the plate 32 is a semi-cylindrical extension arbor 40 having an end disc 42 similar to the disc 32 at the other end. This semi-circular extension arbor has a plurality of recesses 44, 46, 48 and so on for receiving spools of thread, needles, pins, buttons and other accessories for sewing.

Mounted on the extension arbor 40 is a hollow cylindrical sleeve 50 having an inner cylindrical bore 52 which has a slip fit over the extension arbor 40 and the discs 32, 42. This sleeve is preferably formed of a light material such as polyethylene foam plastic which can be injection molded or otherwise shaped to the proper dimension and configuration.

This material has quite a rough exterior which, however, is soft enough that it will not be harmful to any fine fabrics that are carried thereby. It thus provides sufficient friction that material draped over it or wrapped around it will be stabilized so that portions of it may be worked on by a handicapped persons. Other materials in the form of rubber, synthetics and the like may be used. The sleeve will slip on and off of the extension arbor 40 and, of course, it will be seen that because of the flexibility of the gooseneck arm 24, the sleeve may be positioned at varying angles and twisted this way and that to make it most convenient for any particular function. In addition to being mounted by positioning the suction cups 12 on a smooth surface, the device may also be used in a chair wherein the plate 10 underlies the thigh of a person doing the sewing so that the sewing in effect can be done in the lap.

Modified structures can be utilized. For example, FIG. 6 illustrates a modified mounting wherein an enlarged end plate 60 is provided with a threaded recess 62 so that a sleeve 64 can be threaded into the recess and retained in this manner as well as being supported by a cylindrical core. The retention might be accomplished by the plate 60 in the event the cylindrical core is undesirable.

Also, a pin projection 66 is provided on this embodiment to help with the knotting of thread, the pin providing a kind of anchor post around which the thread may be wrapped for mounting or for breaking.

FIG. 3 shows a modified cylinder 70 which could be mounted either in the manner shown in FIG. 1 or FIG. 6, this cylinder having a relatively wide notch 72 at the end which can be used as a holding device for the sewing on of buttons. In FIG. 4, another modified cylinder 74 is illustrated with an elongate narrow slot 76 which can be used for holding patterns or paper or cardboard to make it possible to adapt the device to a holder for drawing, sketching and the like as well as a sewing aid.

In FIG. 5, a modified sleeve 80 has a rounded end 82 which allows it to be used in the same manner as the well-known darning egg for mending socks and other sleeve-like items. Thus, the various cylinders may be applied when desired for the particular type of sewing which is to be accomplished, but in each case, the cylinder has preferably a surface which is rough or has a high friction characteristic and of such material that it will not snag or tear fine fabrics that are draped over it. Styrofoam, which is relatively light, has been found to be satisfactory and serves to hold the material even without the use of any pins or other fastening elements. A cylinder covered with mohair or velvet could also serve although the styrofoam is preferred. It will be seen that the device permits the fabric or the garment to be securely located in a convenient place so that a sewing can be accomplished with one hand without difficulty.

I claim:

1. A sewing aid for handicapped persons who have suffered the loss of use of a hand which comprises:

(a) a flat elongate support base to rest at table top level on a flat supporting surface, (b) means on said base to grip a supporting surface, (c) a flexible goose-neck arm supported at one end of said elongate base extending upward and having a distal portion arched to extend in a direction parallel to the base, (d) a supporting arbor extending outward from said distal end of said goose-neck arm positionable over said base, and (e) a cylinder telescoped on and supported by said arbor formed of a light rough material such as foamed plastic to frictionally engage fabric thus permitting the user to sew with one hand.

2. An aid as defined in claim 1 in which said extension arbor is provided with open-top recesses for sewing accessories, said arbor having a telescoping slip-on fit relative to said cylinder.

3. An aid as defined in claim 1 in which said cylinder has a notch in a free end to facilitate the sewing of buttons.

4. An aid as defined in claim 1 in which said cylinder has a rod-like extension to facilitate tying of knots in thread.

* * * * *